US010041491B2

(12) United States Patent
Ando

(10) Patent No.: US 10,041,491 B2
(45) Date of Patent: Aug. 7, 2018

(54) VANE PUMP CONTAINING A BACK PRESSURE INTRODUCTION PASSAGE

(75) Inventor: Kazuya Ando, Okazaki (JP)

(73) Assignee: JTEKT CORPORATION, Osaka-shi (JP)

( * ) Notice: Subject to any disclaimer, the term of this patent is extended or adjusted under 35 U.S.C. 154(b) by 1567 days.

(21) Appl. No.: 12/820,386

(22) Filed: Jun. 22, 2010

(65) Prior Publication Data

US 2010/0329917 A1 Dec. 30, 2010

(30) Foreign Application Priority Data

Jun. 30, 2009 (JP) ..... 2009-155820

(51) Int. Cl.
*F04C 2/344* (2006.01)
*F01C 21/08* (2006.01)
*F01C 21/10* (2006.01)

(52) U.S. Cl.
CPC ..... *F04C 2/3446* (2013.01); *F01C 21/0863* (2013.01); *F01C 21/108* (2013.01)

(58) Field of Classification Search
USPC ..... 418/75, 78–80, 82, 133, 259–260, 268, 418/269, 267
See application file for complete search history.

(56) References Cited

U.S. PATENT DOCUMENTS 3,216,363 A * 11/1965 Snow et al. ..... 418/135
3,900,277 A * 8/1975 Newton ..... 418/184
4,447,196 A * 5/1984 Nagasaku et al. ..... 418/93
4,505,654 A * 3/1985 Dean et al. ..... 418/80
5,266,018 A * 11/1993 Niemiec ..... 418/82
6,216,815 B1 4/2001 Inaguma et al.
6,375,441 B1 * 4/2002 Ichizuki et al. ..... 418/30
6,422,845 B1 * 7/2002 Wong et al. ..... 418/133
6,976,830 B2 * 12/2005 Uchino ..... 417/220
7,628,596 B2 * 12/2009 Staton et al. ..... 418/268
2002/0119065 A1 * 8/2002 Palakodati et al. ..... 418/259

FOREIGN PATENT DOCUMENTS

JP A-10-306783 11/1998
JP A-2005-307854 11/2005

OTHER PUBLICATIONS

Definition of "groove" from the American Heritage Dictionary found on the Internet.*
Feb. 19, 2013 Notice of Reasons for Rejection issued in Japanese Patent Application No. 2009-155820 (with English translation).

* cited by examiner

*Primary Examiner* — Mark Laurenzi
*Assistant Examiner* — Paul Thiede
(74) *Attorney, Agent, or Firm* — Oliff PLC

(57) ABSTRACT

In a vane pump, a communication groove that provides communication between a communication hole and a discharge port is formed in an outer side face of a rear housing. An opening of the communication groove is blocked by a fitting face of a control valve case. A back-pressure introduction passage that provides communication between the communication hole and an outlet is formed by the communication groove and the fitting face of the control valve case. The back-pressure introduction passage is formed between the rear housing and the control valve case, that is, on the outer side of the housing.

4 Claims, 7 Drawing Sheets

VANE PUMP CONTAINING A BACK PRESSURE INTRODUCTION PASSAGE

INCORPORATION BY REFERENCE

The disclosure of Japanese Patent Application No. 2009-155820 filed on Jun. 30, 2009 including the specification, drawings and abstract is incorporated herein by reference in its entirety.

BACKGROUND OF THE INVENTION

1. Field of the Invention

The invention relates to a vane pump that supplies pressurized oil to, for example, a transmission or a power steering system of a vehicle.

2. Description of the Related Art

A vane pump described in, for example, Japanese Patent Application Publication No. 10-306783 (JP-A-10-306783) is used to supply pressurized oil to, for example, a transmission or a power steering system of a vehicle.

This vane pump includes a housing, a cam ring, and a rotor. The housing is fixed to a component to which hydraulic pressure is supplied (hereinafter, referred to as "hydraulic pressure supply destination component"), for example, a transmission. The cam ring is provided in the housing, and has an inner peripheral face that is in a noncircular shape in a cross section and that is used as a cam face. The rotor is provided on the inner side of the cam ring, and rotates about a rotating shaft. The housing is formed of a front housing, a rear housing and a side plate. In a housing recess of the front housing, the side plate and the cam ring are stacked in this order from the bottom side. The rear housing is fixed to the front housing so as to cover an opening of the housing recess. One of the side faces of each of the cam ring and the rotor contacts the side plate, and the other side face of each of the cam ring and the rotor contacts the rear housing. Multiple slits that extend in the radial direction are formed in the outer peripheral face of the rotor at regular intervals in the circumferential direction. Vanes are slidably fitted in the slits. When driving force is input in the rotating shaft, the rotor rotates while the ends of the vanes slide on the cam face. As the rotor rotates, the volume of each vane chamber formed between consecutive vanes changes. The change in the volume of each vane chamber causes pumping action. The pressurized oil is introduced into the vane chambers through an inlet formed in the side plate, and delivered to an outlet that is also formed in the side plate.

The vane pump uses the hydraulic pressure, which is generated by the vane pump itself, as urging force that urges the vanes in such a direction that the vanes project from the outer periphery of the rotor in order to move the vanes while the vanes slide on the cam face. More specifically, at a position that corresponds to the inner end portion of each slit, a vane back-pressure chamber is formed by the inner end portion, the side plate and the rear housing. The outlet is connected to the vane back-pressure chamber through a back-pressure introduction passage formed in the side plate. A portion of the pressurized oil delivered to the outlet is introduced into the vane back-pressure chamber, and the hydraulic pressure of the pressurized oil acts as the urging pressure that urges the vane in such a direction that the vane projects from the outer periphery of the rotor.

However, in this vane pump, the rotor and the side plate are arranged next to each other in the axial direction in the housing in order to form the back-pressure introduction passage through which the discharge pressure is introduced from the outlet to the vane back-pressure chamber. Therefore, the axial length of the vane pump is increased by an amount corresponding to the side plate. There is a demand to reduce the axial length of the vane pump in order to reduce the installation space for the vane pump. However, there is a limit to reduction in the axial length of the vane pump because the side plate is an indispensable component.

SUMMARY OF THE INVENTION

It is an object of the invention to provide a vane pump that is free of the above-described problem.

An aspect of the invention relates to a vane pump that includes: a housing; a cam ring that is provided in the housing; a rotor that is rotatably provided on an inner side of the cam ring, and that has an outer peripheral face in which multiple vane housing portions that extend in a radial direction are formed; and multiple vanes that are slidably provided in the vane housing portions. In the vane pump, a portion of hydraulic fluid discharged by an operation of the vanes caused by rotation of the rotor is introduced into vane back-pressure chambers formed at inner end portions of the vane housing portions, whereby the vanes are pushed against an inner periphery of the cam ring. The housing has a discharge port to which the hydraulic fluid is discharged by the operation of the vanes caused by the rotation of the rotor, and a communication hole that provides communication between a portion of an inner face of the housing, which forms the vane back-pressure chambers together with the inner end portions, and an outer face of the housing. A back-pressure introduction passage that provides communication between the discharge port and the communication hole is formed with the use of the outer face of the housing.

With the configuration described above, because communication is provided between the discharge port and the communication hole by the back-pressure introduction passage formed with the use of the outer face of the housing, a portion of the hydraulic fluid that is discharged to the discharge port is introduced into the vane back-pressure chambers through the back-pressure introduction passage and the communication hole. Therefore, unlike the case where the back-pressure introduction passage is formed in the housing, it is possible to introduce a portion of the hydraulic fluid discharged to the discharge port to the vane back-pressure chambers without providing a side plate in the housing. Therefore, it is possible to reduce the axial length of the vane pump by an amount corresponding to a side plate that may be provided in the housing.

BRIEF DESCRIPTION OF THE DRAWINGS

The foregoing and further features and advantages of the invention will become apparent from the following description of an example embodiment with reference to the accompanying drawings, wherein like numerals are used to represent like elements and wherein.

DETAILED DESCRIPTION OF THE EMBODIMENT

Hereafter, a vane pump according to an embodiment of the invention will be described. The vane pump according to the embodiment supplies pressurized oil, used as hydraulic fluid, to a transmission.

Figure 1:
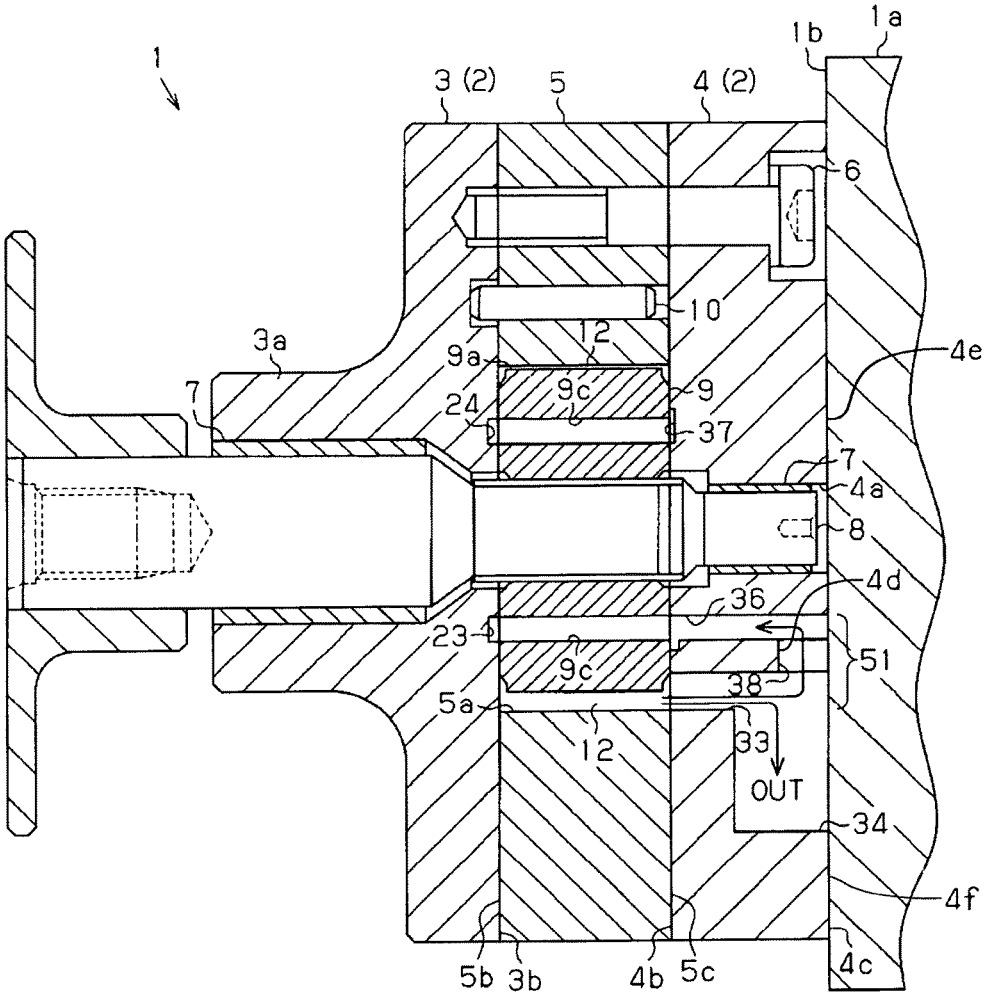
FIG. 1 is a cross-sectional view schematically showing a vane pump, taken along the line A-A in FIG. 2.

As shown in FIG. 1, a housing 2 of a vane pump 1 is formed of a front housing 3 and a rear housing 4 each of which has a substantially flat plate shape. The rear housing 4 is fixed to a control valve case 1*a* of a transmission that is a hydraulic pressure supply destination component. A cam ring 5 is clamped between the rear housing 4 and the front housing 3. The front housing 3, the rear housing 4 and the cam ring 5 are fixed to each other with two bolts 6 (see FIG. 2). Sealing elements such as O-rings (not shown) are provided between the front housing 3 and the cam ring 5, between the cam ring 5 and the rear housing 4, and between the rear housing 4 and a fitting face 1*b* of the control valve case 1*a*. Thus, sufficient liquid-sealing is provided between these components.

A cylindrical bearing holding portion 3*a* that extends away from the cam ring 5 is formed at the center portion of the front housing 3. A bearing holding hole 4*a* is formed at the center portion of the rear housing 4. Bearings 7 are provided in the bearing holding portion 3*a* and the bearing holding hole 4*a*. The bearings 7 rotatably support a rotating shaft 8 that is arranged coaxially with a cam face 5*a* formed in the inner peripheral face of the cam ring 5. A rotor 9 is fitted to the rotating shaft 8. The rotor 9 is housed in the cam ring 5.

Figure 2:
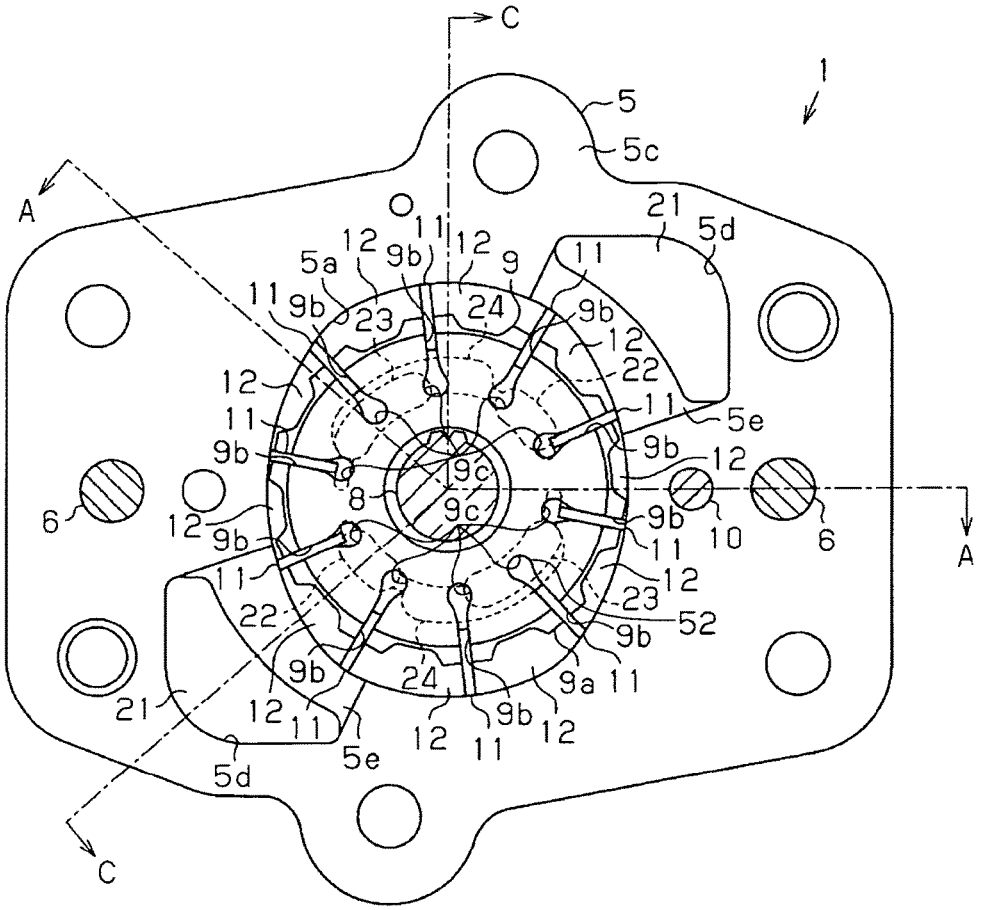
FIG. 2 is a cross-sectional view showing a cam ring and a rotor, taken along the line B-B in FIG. 3.

As shown in FIG. 1, the cam ring 5 is clamped between an inner side face 3*b* of the front housing 3 and an inner side face 4*b* of the rear housing 4. The position of the cam ring 5 with respect to the front housing 3 is determined by a pin 10, and the cam ring 5 is fixed to the front housing 3 by the pin 10. As shown in FIG. 2, the cam face 5*a* of the cam ring 5 has a substantially ellipsoid shape in a cross section. The distance from the axis of the cam ring 5 to the outer periphery of the cam face 5*a* changes in a cycle of 180 degrees. Paired through-holes 5*d* that pass through the cam ring 5 from one side face 5*b* to the other side face 5*c* are formed in the cam ring 5 (see FIG. 3). The paired through-holes 5*d* are on diametrically opposite sides of the axis of the rotating shaft 8. In the four portions in the side faces 5*b* and 5*c*, which are located between the through-holes 5*d* and the cam face 5*a*, there are formed recesses 5*e* that extend from the through-holes 5*d* to the cam face 5*a*.

As shown in FIG. 1, the rotor 9 is arranged in such a manner that one of the side faces thereof is slidable with respect to the inner side face 3*b* of the front housing 3 and the other side face thereof is slidable with respect to the inner side face 4*b* of the rear housing 4. The rotor 9 is spline-connected to the rotating shaft 8. As shown in FIG. 2, in an outer peripheral face 9*a* of the rotor 9, ten vane housing portions 9*b* are formed at regular intervals in the circumferential direction of the rotor 9. The ten vane housing portions 9*b* extend in a radial fashion, that is, extend in the radial direction of the rotor 9. The vane housing portions 9*b* extend throughout the rotor 9 in the axial direction of the rotor 9. Inner end portions 52 of the vane housing portions 9*b* are through-holes that extend in the axial direction of the rotor 9. Vane back-pressure chambers 9*c* are formed by the inner end portions 52, the inner side face 3*b* of the front housing 3, and the inner side face 4*b* of the rear housing 4.

Vanes 11, each of which has the same width as the axial width of the rotor 9, are housed in the vane housing portions 9*b* so as to be slidable in the radial direction. That is, the vanes 11 are supported in and guided along the vane housing portions 9*b* so as to be able to reciprocate in the radial direction of the rotor 9. The cross section of the edge of each vane 11 is in an arc-shape. The edge of each vane 11 slidably contacts the cam face 5*a*. One of the side edges of each vane 11 slidably contacts the inner side face 3*b* of the front housing 3 and the other side edge of the vane 11 slidably contacts the inner side face 4*b* of the rear housing 4. The vanes 10 partition the space defined by the front housing 3, the rear housing 4, the cam ring 5 and the rotor 9 into ten vane chambers 12. When driving force is input in the rotating shaft 8 and the rotor 9 rotates, the volume of each vane chamber 12 increases and decreases in a cycle in accordance with the rotation of the rotor 9.

Figure 3:
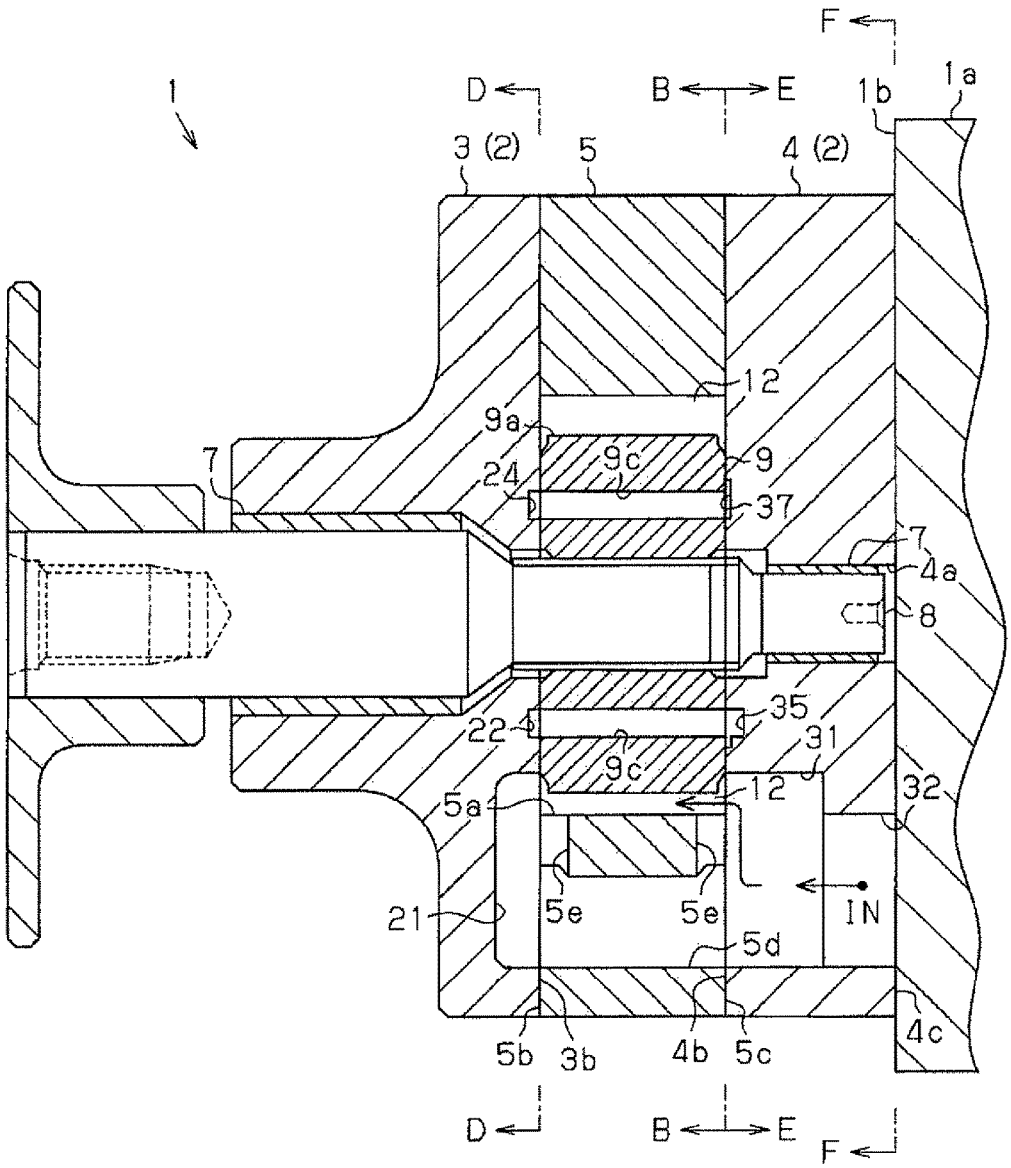
FIG. 3 is a cross-sectional view schematically showing the vane pump, taken along the line C-C in FIG. 2.
Figure 4:
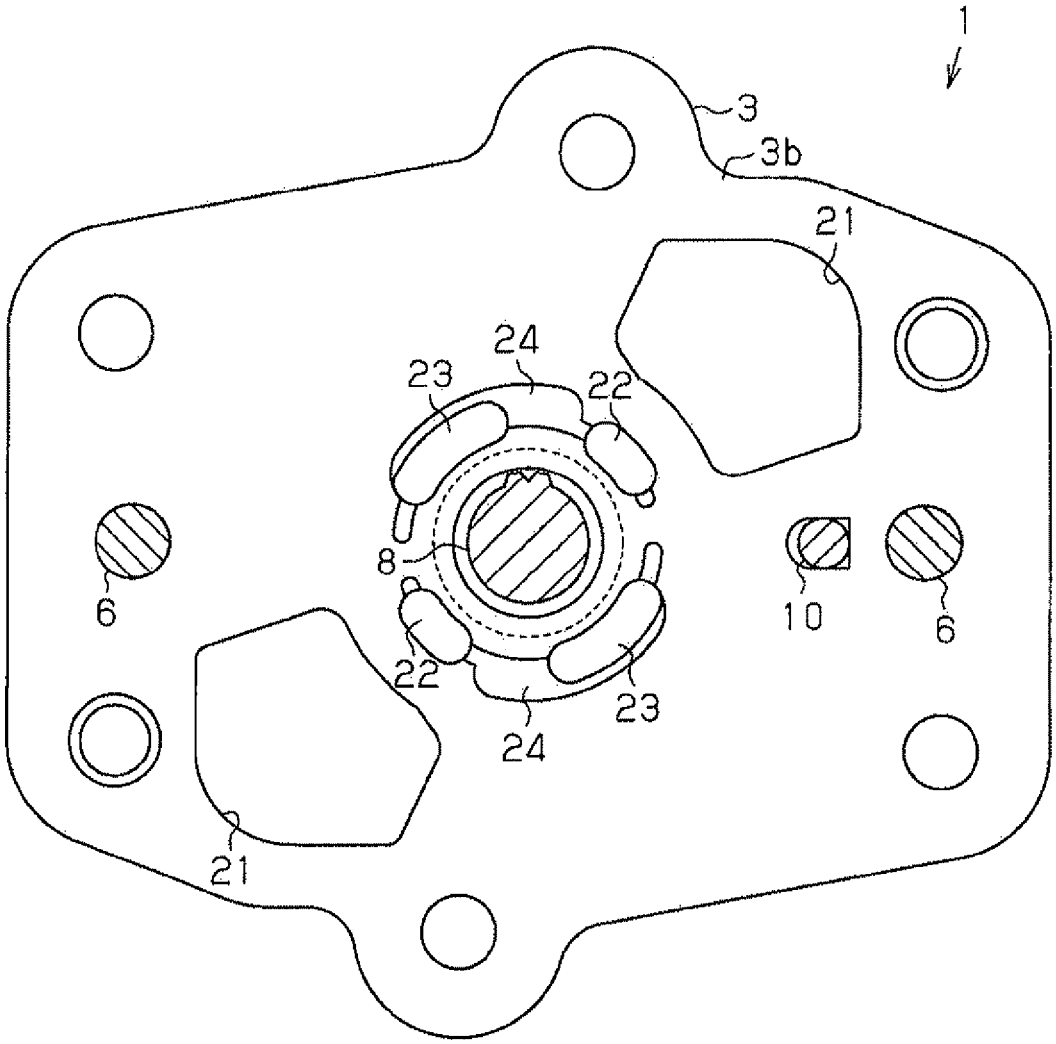
FIG. 4 is a cross-sectional view showing the inner side face of a front housing, taken along the line D-D in FIG. 3.

As shown in FIG. 3, paired intake ports 21 are formed in the inner side face 3*b* of the front housing 3 at positions that correspond to the vane chambers 12 where the volume increase stroke takes place. As shown in FIG. 4, the paired intake ports 21 are formed on diametrically opposite sides of the axis of the rotating shaft 8.

As shown in FIG. 4, two first pressure introduction grooves 22 and two second pressure introduction grooves 23 are formed in the inner side face 3*b* of the front housing 3 at a portion that corresponds to the rotor 9. Each of the first pressure introduction groove 22 and the second pressure introduction groove 23 is in a shape of an arc of which the center coincides with the axis of the rotating shaft 8 (rotor 9). When viewed in the axial direction, the first pressure introduction grooves 22 are positioned on the inner side of the intake ports 21. The first pressure introduction grooves 22 and the second pressure introduction grooves 23 are alternately formed in the circumferential direction. Each communication recess 24 that extends in the circumferential direction provides communication between the first pressure introduction groove 22 and the second pressure introduction groove that are next to each other in the circumferential direction. As shown in FIG. 3, the pressure introduction grooves 22 and 23 and the communication recesses 24 are formed in a portion of the inner side face 3*b* of the front housing 3, which forms the vane back-pressure chambers 9*c* together with the inner end portions of the vane housing portions 9*b*. The pressure introduction grooves 22 and 23 and the communication recesses 24 are always communicated with the vane back-pressure chambers 9*c*.

As shown in FIG. 3, paired intake ports 31 are formed in the inner side face 4*b* of the rear housing 4 at positions that correspond to the vane chambers 12 where the volume increase stroke takes place, as in the case of the inner side face 3*b* of the front housing 3. The paired intake ports 31 are formed so as to correspond to the intake ports 21 that are formed in the inner side face 3*b* of the front housing 3. The paired intake ports 31 are formed on diametrically opposite sides of the axis of the rotating shaft 8. (see FIG. 5).

As shown in FIG. 3, the intake ports 31 of the rear housing 4 are communicated with the intake ports 21 of the front housing 3 through the corresponding through-holes 5*d* that are formed in the cam ring 5. Inlets 32 are formed in an outer side face 4*c* of the rear housing 4. The intake ports 31 are communicated with the inlets 32, and communicated with an oil reservoir (not shown) through the inlets 32.

As shown in FIG. 1, paired discharge ports 33 are formed in the inner side face 4*b* of the rear housing 4 at positions that correspond to the vane chambers 12 where the volume decrease stroke takes place. The paired discharge ports 33 are formed on diametrically opposite sides of the axis of the rotating shaft 8 (see FIG. 5). In the outer side face 4*c* of the rear housing 4, outlets 34 are formed. The discharge ports 33 are communicated with the outlets 34, and communicated with a transmission-side portion through the outlets 34.

Figure 5:
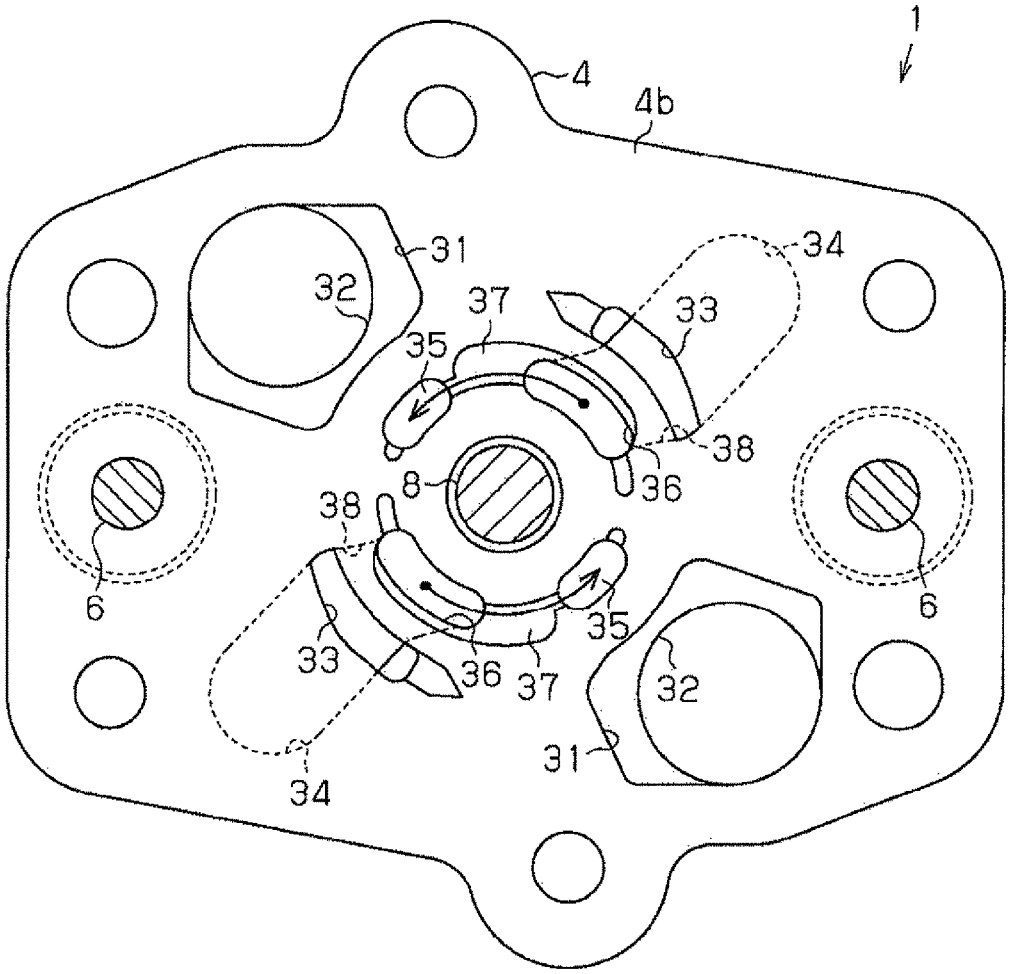
FIG. 5 is a cross-sectional view showing the inner side face of a rear housing, taken along the line E-E in FIG. 3.

As shown in FIG. 5, two pressure introduction grooves 35 are formed in the inner side face 4*b* of the rear housing 4. Each pressure introduction groove 35 is in a shape of an arc of which the center coincides with the axis of the rotating shaft 8 (rotor 9). Similarly, in the inner side face 4*b* of the rear housing 4, there are formed two communication holes 36 that extend through the rear housing 4 from the inner side face 4*b* to the outer side face 4*c*. The cross section of each communication hole 36 is in a shape of an arc of which the center coincides with the axis of the rotating shaft 8 (rotor 9). When viewed in the axial direction, the pressure introduction grooves 35 are positioned on the inner side of the intake ports 31, and the communication holes 36 are positioned on the inner side of the discharge ports 33. The pressure introduction grooves 35 and the communication holes 36 are alternately formed in the circumferential direction so as to face the first pressure introduction grooves 22 and the second pressure introduction grooves 23 that are formed in the inner side face 3*b* of the front housing 3, respectively. Each communication recess 37 that extends in the circumferential direction provides communication between the pressure introduction groove 35 and the communication hole 36 that are next to each other in the circumferential direction. As shown in FIG. 1, the pressure introduction grooves 35 and 36 and the communication recesses 37 are formed in a portion of the inner side face 4*b* of the rear housing 4, which forms the vane back-pressure chambers 9*c* together with the inner end portions 52 (see FIG.2) of the vane housing portions 9*b*. The pressure introduction grooves 35 and 36 and the communication recesses 37 are always communicated with the vane back-pressure chambers 9*c*.

Figure 6:
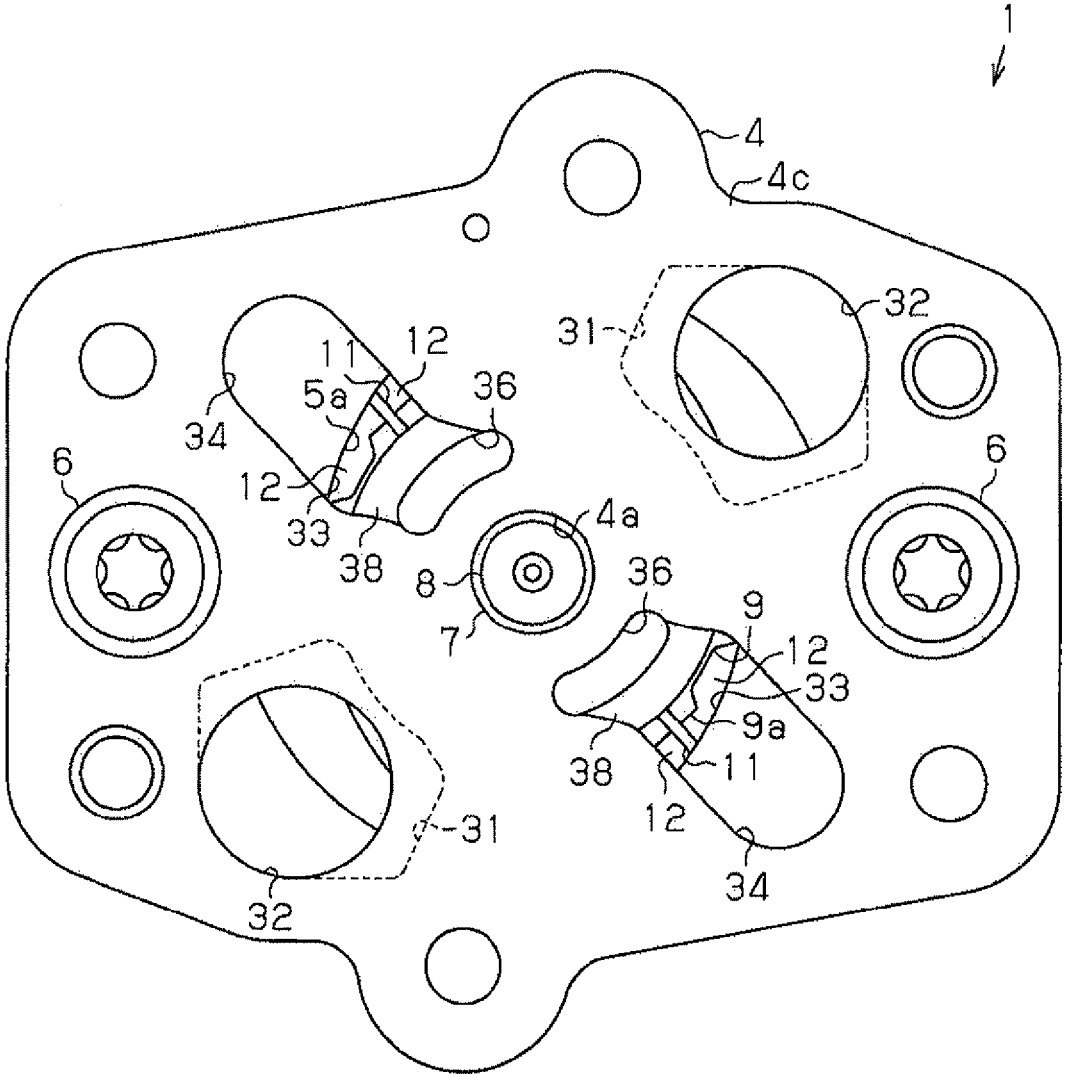
FIG. 6 is a cross-sectional view showing the outer side face of the rear housing, taken along the line F-F in FIG. 3.

As shown in FIG. 6, two communication grooves 38 are formed in the outer side face 4*c* of the rear housing 4. The two communication grooves 38 serve to form the housing-side recesses that provide communication between the communication holes 36 and the discharge ports 33. As shown in FIG. 1, the rear housing 4 is fitted at the outer side face 4*c* to the fitting face 1*b* of the control valve case 1*a*, and the opening of each housing-side recess is blocked by the fitting face 1*b*. In other words, an outermost part of the outer side face 4*c* of the rear housing 4, which includes a radially inner portion 4*e* and a radially outer portion 4*f* of the outer side face 4*c* of the rear housing 4, is placed against the fitting face 1*b* of the control valve case 1*a*. The communication grooves 38 and the fitting face 1*b* of the control valve 1*a* form the back-pressure introduction passages 51 that provide communication between the communication holes 36 and the outlets 34. The back-pressure introduction passages 51 are formed between the rear housing 4 and the control valve case 1*a*, that is, on the outer side of the housing 2. In other words, in this embodiment, the back-pressure introduction passages 51 are formed between an outer facing surface 4*d* of the rear housing 4 and the fitting face 1*b* of the control valve case 1*a* (thus the back-pressure introduction passages 51 are formed in the rear housing 4).

The action of the vane pump 1 configured in the above-described manner will be described below. When driving force is input in the rotating shaft 8 and the rotating shaft 8 and the rotor 9 rotate, the pressurized oil is introduced into the vane chambers 12 through the inlets 32 and the intake ports 31 (see FIG. 3). Then, the volume of each vane chamber 12 periodically increases and decreases in accordance with the rotational angle of the rotor 9. This is known pumping action. As a result, the pressurized oil is discharged to the discharge ports 33, and then delivered from the discharge ports 33 to the outlets 34 (see FIG. 1).

When the pumping action is caused, a portion of the pressurized oil that is discharged to the outlets 34 through the discharge ports 33 is introduced to the end portions of the communication holes 36 on the outer side face 4*c*-side through the communication grooves 38 formed in the outer side face 4*c* of the rear housing 4, more specifically, the back-pressure introduction passages 51 (see FIG. 1) that are formed between the rear housing 4 and the fitting face 1*b* of the control valve case 1*a* (see FIG. 1). Then, the pressurized oil is introduced to the communication recesses 37 and the pressure introduction grooves 35 formed in the inner side face 4*b* of the rear housing 4 through the communication holes 36 (see FIG. 5). Then, the pressurized oil is introduced to the vane back-pressure chambers 9*c* of the rotor 9, and the first pressure introduction grooves 22, the communication recesses 24 and the second pressure introduction grooves 23 of the front housing 3 (see FIG. 1). As described above, a portion of the pressurized oil discharged to the discharge ports 33 is introduced to the vane back-pressure chambers 9*c* through the back-pressure introduction passages 51 (see FIG. 1) formed outside the housing 2. Thus, the discharge pressure in the discharge ports 33 is applied to the inner end portions of the vane 11*s*. Then, the vanes 11 project from the outer peripheral face 9*a* of the rotor 9, and the outer end portions of the vanes 11 slide on the cam face 5*a* of the cam ring 5.

1) Communication is provided between the discharge ports 33 and the communication holes 36 by the back-pressure introduction passages that are formed with the use of the communication grooves 38 formed in the outer side face 4*c* of the rear housing 4. Therefore, a portion of the pressurized oil discharged to the discharge ports 33 is introduced into the vane back-pressure chambers 9c through the communication grooves 38 and the communication holes 36. Therefore, unlike the case where the back-pressure introduction passages 51 are formed in the housing 2, it is possible to introduce a portion of the pressurized oil discharged to the discharge ports 33 to the vane back-pressure chambers 9*c* without providing a side plate in the housing 2. Therefore, it is possible to reduce the axial length of the vane pump 1 by an amount corresponding to a side plate that may be provided in the housing 2. In addition, the installation space for the vane pump 1 is reduced, and the ease in mounting the vane pump 1 in a vehicle is increased.

2) When the back-pressure introduction passages 51 are formed with the use of the outer face of the housing 2, an element that forms the fluid passages by contacting the outer face of the housing 2 is required. In the embodiment described above, the fitting face 1*b* of the control valve case 1*a* is used as the element that forms the fluid passages. That is, because the communication grooves 38 are formed between the outer side face 4*c* of the rear housing 4 and the fitting face 1*b* of the control valve case 1*a* that contacts the outer side face 4*c*, it is possible to form the back-pressure introduction passages 51 without providing an extra member for forming the back-pressure introduction passages 51 in the outer face of the housing 2.

3) It is possible to form the back-pressure introduction passages 51 on the outer side of the housing 2 by just forming the communication grooves 38 in the outer side face 4*c* of the rear housing 4. Therefore, it is possible to easily form the back-pressure introduction passages 51 without executing an extra process on the control valve case 1*a*.

The above-described embodiment may be modified as follows.

Figure 7A:
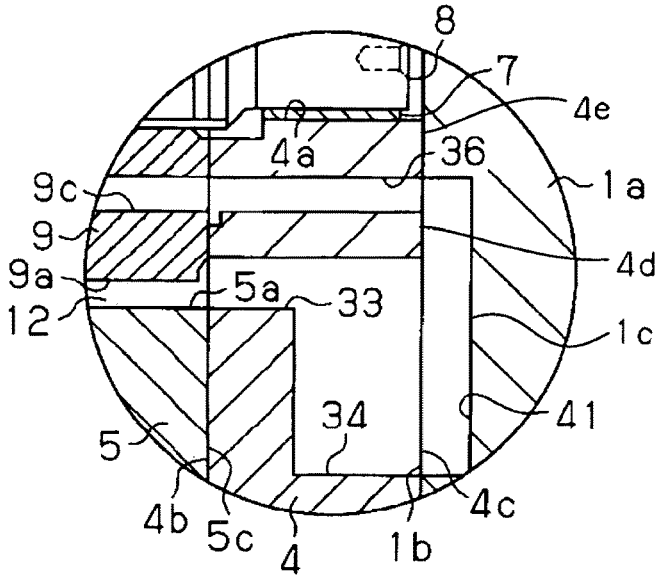
FIG. 7A is an enlarged view showing a portion of a vane pump in another example.
Figure 7B:
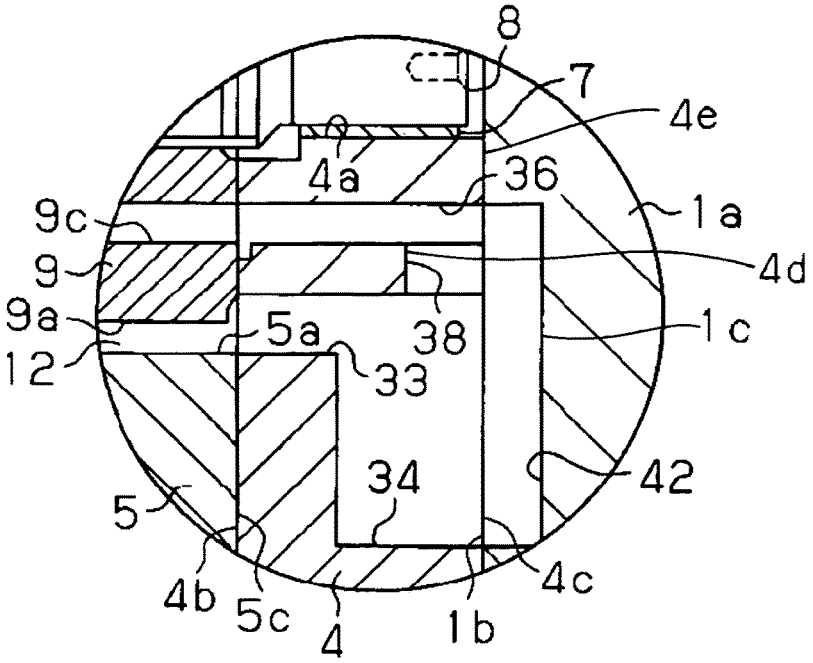
FIG. 7B is an enlarged view showing a portion of a vane pump in another example.

In the embodiment described above, the back-pressure introduction passages 51 are formed on the outer side of the housing 2 with the use of the communication grooves 38 formed in the outer side face 4*c* of the rear housing 4. However, the manner for forming the back-pressure introduction passages 51 is not limited to this. For example, as shown in FIG. 7A, the communication grooves 38 in the outer side face 4*c* of the rear housing 4 may be omitted, and communication grooves 41 that serve as hydraulic pressure supply target-side recesses may be formed in the fitting face 1*b* of the control valve case 1*a*. In other words, in this embodiment, the back-pressure introduction passages 51 are formed between the outer facing surface 4*d* of the rear housing 4 and the adjacent face 1*c* of the control valve case 1*a* (thus the back-pressure introduction passages 51 are formed in the control valve case 1*a*). Alternatively, as shown in FIG. 7B, the communication grooves 38 may be formed in the outer side face 4*c* of the rear housing 4 and communication grooves 42 may be formed in the fitting face 1*b* of the control valve case 1*a*. In other words, in this embodiment, the back-pressure introduction passages 51 are formed between the outer facing surface 4*d* of the rear housing 4 and the adjacent face 1*c* of the control valve case 1*a* (thus the back-pressure introduction passages 51 are formed in both the rear housing 4 and the control valve case 1*a*).

In the embodiment described above, the openings of the communication grooves 38 are blocked by the fitting face 1*b* of the control valve case 1*a* that is the hydraulic pressure supply destination component. However, the manner for blocking the openings of the communication grooves 38 is not limited to this. For example, the openings of the communication grooves 38 may be blocked by the outer face of a device other than the hydraulic pressure supply destination component, or another member, for example, a cover.

In the embodiment described above, the invention is applied to the vane pump 1 that is formed by clamping the cam ring 5 between the front housing 3 and the rear housing 4 each of which has a substantially flat plate shape. However, the invention may be applied to other vane pumps. For example, the invention may be applied to a vane pump in which a housing recess that opens to a rear housing is formed in a front housing, a cam ring is housed in the housing recess, and the opening of the housing recess is blocked by the rear housing.

In the embodiment described above, the invention is applied to the vane pump 1 that supplies pressurized oil to the transmission. However, the invention may be applied to a vane pump that supplies pressurized oil to another device, for example, a power steering system.

What is claimed is:

1. A vane pump, comprising:

a shaft including an end;

a pump housing having a front housing and a rear housing, the front and rear housings each having an inner face and an outer face, the rear housing comprising a communication hole that provides communication between a portion of the inner face of the rear housing and the outer face of the rear housing, the shaft being received into the front housing and the rear housing such that the end of the shaft is disposed in the rear housing;

a cam ring that is provided between the inner face of the front housing and the inner face of the rear housing;

a rotor that is rotatably provided on a radially inner side of the cam ring, and that has a radially outer peripheral face in which multiple vane housing portions that extend in a radial direction are formed, each vane housing portion comprising a vane back-pressure chamber formed at a radially inner end portion of the vane housing portion;

a vane slidably provided in each of the vane housing portions;

a hydraulic pressure supply destination component with the outer face of the rear housing fitted to a fitting face of the hydraulic pressure supply destination component; and a back-pressure introduction passage that is between a discharge port and the communication hole and connects the discharge port to the communication hole, the back-pressure introduction passage being formed between an outer facing surface of the rear housing and one of the fitting face or an adjacent face of the hydraulic pressure supply destination component, wherein the outer face of the rear housing includes a radially inner portion disposed proximate the end of the shaft and a radially outer portion remotely spaced apart from both the end of the shaft and the radially inner portion, the radially inner portion and the radially outer portion of the outer face of the rear housing, respectively, being placed against the fitting face of the hydraulic pressure supply destination component, upon rotation of the rotor, operation of the vanes causes hydraulic fluid to be discharged to the discharge port, and a portion of the discharged hydraulic fluid is introduced into each of the vane back-pressure chambers, whereby the vanes are pushed against an inner periphery of the cam ring.

2. The vane pump according to claim 1, wherein the back-pressure introduction passage is formed between the outer facing surface of the rear housing and the fitting face of the hydraulic pressure supply destination component, such that the back-pressure introduction passage is disposed only in the rear housing.

3. The vane pump according to claim 1, wherein the back-pressure introduction passage is formed between the outer facing surface of the rear housing and the adjacent face of the hydraulic pressure supply destination component, and the outer facing surface is the outer face of the rear surface such that the back-pressure introduction passage is disposed only in a hydraulic pressure supply destination component-side recess formed in the hydraulic pressure supply destination component.

4. The vane pump according to claim 1, wherein the back-pressure introduction passage is formed between two outer facing surface of the rear housing and the adjacent face of the hydraulic pressure supply destination component, such that the back-pressure introduction passage is disposed both in the rear housing and in a hydraulic pressure supply destination component-side recess formed in the hydraulic pressure supply destination component.

* * * * *